US008714938B2

(12) United States Patent
Okuda et al.

(10) Patent No.: US 8,714,938 B2
(45) Date of Patent: May 6, 2014

(54) VARIABLE DISPLACEMENT COMPRESSOR

(75) Inventors: Motoaki Okuda, Aichi-ken (JP); Masaki Ota, Aichi-ken (JP); Masakazu Murase, Aichi-ken (JP); Shun Sumikawa, Aichi-ken (JP); Hiromi Ueda, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 608 days.

(21) Appl. No.: 13/039,731

(22) Filed: Mar. 3, 2011

(65) Prior Publication Data

US 2011/0214564 A1 Sep. 8, 2011

(30) Foreign Application Priority Data

Mar. 8, 2010 (JP) ..... 2010-050371

(51) Int. Cl.
*F04B 1/26* (2006.01)
*F04B 1/12* (2006.01)
*F04B 27/08* (2006.01)

(52) U.S. Cl.
USPC ..... 417/222.2; 417/222.1; 417/269

(58) Field of Classification Search
USPC ..... 417/222.2, 269, 222.1; 137/315.31, 137/315.2
See application file for complete search history.

(56) References Cited

U.S. PATENT DOCUMENTS 5,681,150 A * 10/1997 Kawaguchi et al. ..... 417/222.2
5,964,578 A 10/1999 Suitou et al.
6,241,483 B1 * 6/2001 Kato et al. ..... 417/222.2
6,354,811 B1 * 3/2002 Ota et al. ..... 417/222.2
6,481,227 B1 * 11/2002 Ota et al. ..... 62/209
6,511,297 B2 * 1/2003 Ota et al. ..... 417/222.2
6,517,323 B2 * 2/2003 Kimura et al. ..... 417/222.2
6,729,853 B2 * 5/2004 Umemura et al. ..... 417/222.2
6,733,246 B2 * 5/2004 Imai et al. ..... 417/222.2
6,772,990 B2 8/2004 Sasaki et al.
8,152,482 B2 4/2012 Umemura et al.
2002/0006337 A1 * 1/2002 Kimura et al. ..... 417/222.2

(Continued)

FOREIGN PATENT DOCUMENTS

CN 1333430 1/2002
CN 101418788 4/2009
JP 2001-280237 10/2001

(Continued)

OTHER PUBLICATIONS

China Office action, dated Apr. 22, 2013 along with an english translation thereof.

*Primary Examiner* — Charles Freay
*Assistant Examiner* — Alexander Comley
(74) *Attorney, Agent, or Firm* — Greenblum & Bernstein P.L.C.

(57) ABSTRACT

The variable displacement compressor has a suction-pressure region, a discharge-pressure region and a crank chamber. The compressor includes a supply passage, a bleed passage and a control valve that adjusts cross-sectional area of the bleed passage. The control valve includes a valve chamber, a valve portion and a valve seat member. The valve portion is disposed in the valve chamber for dividing the valve chamber into a bleed chamber, a backpressure chamber and a communication passage. The bleed chamber forms a part of the bleed passage. The backpressure chamber communicates with the supply passage. The communication passage is formed between an outer circumferential surface of the valve portion and an inner circumferential surface of the valve chamber for providing fluid communication between the bleed chamber and the backpressure chamber. The valve seat member is disposed in the bleed chamber and provided separately from a compressor housing forming the valve chamber.

9 Claims, 6 Drawing Sheets

(56) References Cited

U.S. PATENT DOCUMENTS

| | | | | |
|---|---|---|---|---|
| 2002/0035842 | A1* | 3/2002 | Suitou et al. | 62/228.3 |
| 2003/0044291 | A1* | 3/2003 | Umemura et al. | 417/222.2 |
| 2003/0118456 | A1* | 6/2003 | Endo | 417/222.2 |
| 2005/0008499 | A1* | 1/2005 | Umemura et al. | 417/222.2 |
| 2005/0169768 | A1 | 8/2005 | Kawaguchi et al. | |
| 2005/0254961 | A1* | 11/2005 | Kawamura et al. | 417/222.2 |
| 2009/0108221 | A1* | 4/2009 | Umemura et al. | 251/129.15 |
| 2011/0214564 | A1* | 9/2011 | Okuda et al. | 91/505 |

FOREIGN PATENT DOCUMENTS

| | | | |
|---|---|---|---|
| JP | 2002-21721 | A | 1/2002 |
| JP | 2002-257051 | | 9/2002 |
| JP | 2003-228423 | A | 8/2003 |
| JP | 2007-177627 | A | 7/2007 |
| JP | 2007-198349 | A | 8/2007 |

* cited by examiner

VARIABLE DISPLACEMENT COMPRESSOR

BACKGROUND OF THE INVENTION

The present invention relates to a variable displacement compressor that controls the pressure in crank chamber by supplying refrigerant in the discharge-pressure region of the compressor to the crank chamber and discharging refrigerant from the crank chamber to the suction-pressure region of the compressor, thereby controlling the displacement of the compressor.

In a variable displacement compressor having a crank chamber in which a swash plate is disposed so that its inclination angle is variable, the inclination angle of the swash plate decreases as the pressure in the crank chamber rises. This decrease of the inclination angle decreases the stroke length of a piston thereby to decrease the displacement of the compressor. On the other hand, the inclination angle of the swash plate increases as the pressure in the pressure control chamber falls. This increase of the inclination angle increases the stroke length of the piston thereby to increase the displacement of the compressor.

Since compressed refrigerant is supplied to the crank chamber in the variable displacement compressor, the operating efficiency of the variable displacement compressor deteriorates with an increase of the amount of refrigerant discharged from the crank chamber to the suction-pressure region. Therefore, the cross-sectional area of the bleed passage through which the refrigerant is discharged from the crank chamber to the suction-pressure region should be made as small as possible from the point of view of the operating efficiency of the variable displacement compressor.

When the variable displacement compressor is at a stop for a long time, the refrigerant in the crank chamber is liquefied and remains there. If the cross-sectional area of the bleed passage is fixed at a small value, the liquefied refrigerant in the crank chamber cannot be discharged to the suction-pressure region rapidly when the variable displacement compressor is started. The liquefied refrigerant in the crank chamber is vaporized during the start-up of the compressor, so that the pressure in the crank chamber is increased excessively. Therefore, it takes a long time before the displacement of the variable displacement compressor increases to a desired level after the compressor is started.

Japanese Patent Application Publication No. 2002-21721 discloses a displacement control unit for a variable displacement compressor for solving the problem mentioned above. The displacement control unit of the publication includes a first control valve for varying the cross-sectional area of a supply passage through which refrigerant is supplied from the discharge-pressure region to the crank chamber, and a second control valve for varying the cross-sectional area of a bleed passage through which refrigerant is discharged from the crank chamber to the suction-pressure region. The first control valve is an electromagnetically-operated valve that varies the valve opening by changing its electromagnetic force. When no electric current flows in the first control valve, its valve opening is maximized and the inclination angle of the swash plate is minimized. Thus, the compressor is operated at its minimum displacement. When an electric current flows in the first control valve, its valve opening is made smaller than the maximum opening and the inclination angle of the swash plate is made larger than the minimum, accordingly. Thus, the compressor is operated at an intermediate displacement where the displacement is not fixed at the minimum displacement.

The second control valve has a spool disposed in a spool chamber. The spool is a valve member for varying the cross-sectional area of the bleed passage and dividing the spool chamber into an internal space and a backpressure chamber. The backpressure chamber communicates with a pressure region located downstream of the first control valve, and the internal space communicates with the crank chamber via the bleed passage. The spool is urged toward the backpressure chamber by a spring. The spool is formed with a communication groove for providing a minimum cross-sectional area of the bleed passage. When the compressor is started, the first control valve is closed to move the spool of the second control valve in the direction that increases the cross-sectional area of the bleed passage. Thus, the liquefied refrigerant in the crank chamber is discharged to the suction-pressure region rapidly. Therefore, the time taken before the displacement of the compressor increases after the compressor is started is reduced.

When the first control valve is energized and placed in its open position, the second control valve is placed in its closed position where the spool is seated on its valve seat. Thus, discharging of the refrigerant from the crank chamber to the suction-pressure region is performed only via the communication groove. In this case, the compressor is operated at an intermediate displacement that is greater than the minimum displacement.

As the cross-sectional area of the communication groove is made smaller, the pressure in the internal space of the spool when the second control valve is in its closed position is made closer to the pressure in the crank chamber. When the opening of the first control valve is restricted, the pressure in the backpressure chamber is only slightly larger than the pressure in the internal space of the spool.

In order to move the second control valve to the closed position under the condition that the pressure in the backpressure chamber is slightly larger than the pressure in the internal space, the urging force of the spring needs to be reduced.

When the second control valve is moved from the closed position to the open position, the spool seated on the valve seat is moved away from the valve seat. The second control valve is formed so that the spool divides the spool chamber into the internal space and the backpressure chamber with a small clearance between the outer circumferential surface of the spool and the inner circumferential surface of the spool chamber. Therefore, if the ingress of any foreign matter into the clearance between the outer circumferential surface of the spool and the inner circumferential surface of the spool chamber may impede the operation of the spool. If the urging force of the spring is too small or no spring is present, the spool cannot move smoothly. That is, if the responsiveness of the second control valve is prevented by the foreign matter, the liquefied refrigerant in the crank chamber cannot be discharged to the suction-pressure region smoothly when the compressor is started.

The present invention is directed to a variable displacement compressor which prevents the responsiveness of its second control valve from deteriorating.

SUMMARY OF THE INVENTION

In accordance with an aspect of the present invention, there is provided the variable displacement compressor in which a suction-pressure region, a discharge-pressure region and a crank chamber are formed. Displacement of the variable displacement compressor varies in accordance with pressure in the crank chamber. The variable displacement compressor includes a supply passage, a bleed passage, a first control valve and a second control valve. The supply passage is provided for allowing refrigerant in the discharge-pressure region to be supplied into the crank chamber. The bleed passage is provided for allowing the refrigerant in the crank chamber to be discharged to the suction-pressure region. The first control valve is provided for adjusting cross-sectional area of the supply passage. The second control valve is provided for adjusting cross-sectional area of the bleed passage. The second control valve includes a valve hole, a valve chamber, a first valve portion, a second valve portion and a valve seat member. The valve hole forms a part of the bleed passage and is opened to the crank chamber. The valve chamber is opened to the valve hole. The first valve portion is disposed in the valve chamber for adjusting cross-sectional area of the valve hole. The second valve portion is disposed in the valve chamber for dividing the valve chamber into a bleed chamber, a backpressure chamber and a communication passage. The bleed chamber forms a part of the bleed passage. The backpressure chamber communicates with the supply passage. The communication passage is formed between an outer circumferential surface of the second valve portion and an inner circumferential surface of the valve chamber for providing fluid communication between the bleed chamber and the backpressure chamber. The valve seat member is disposed in the bleed chamber and provided separately from a compressor housing forming the valve chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
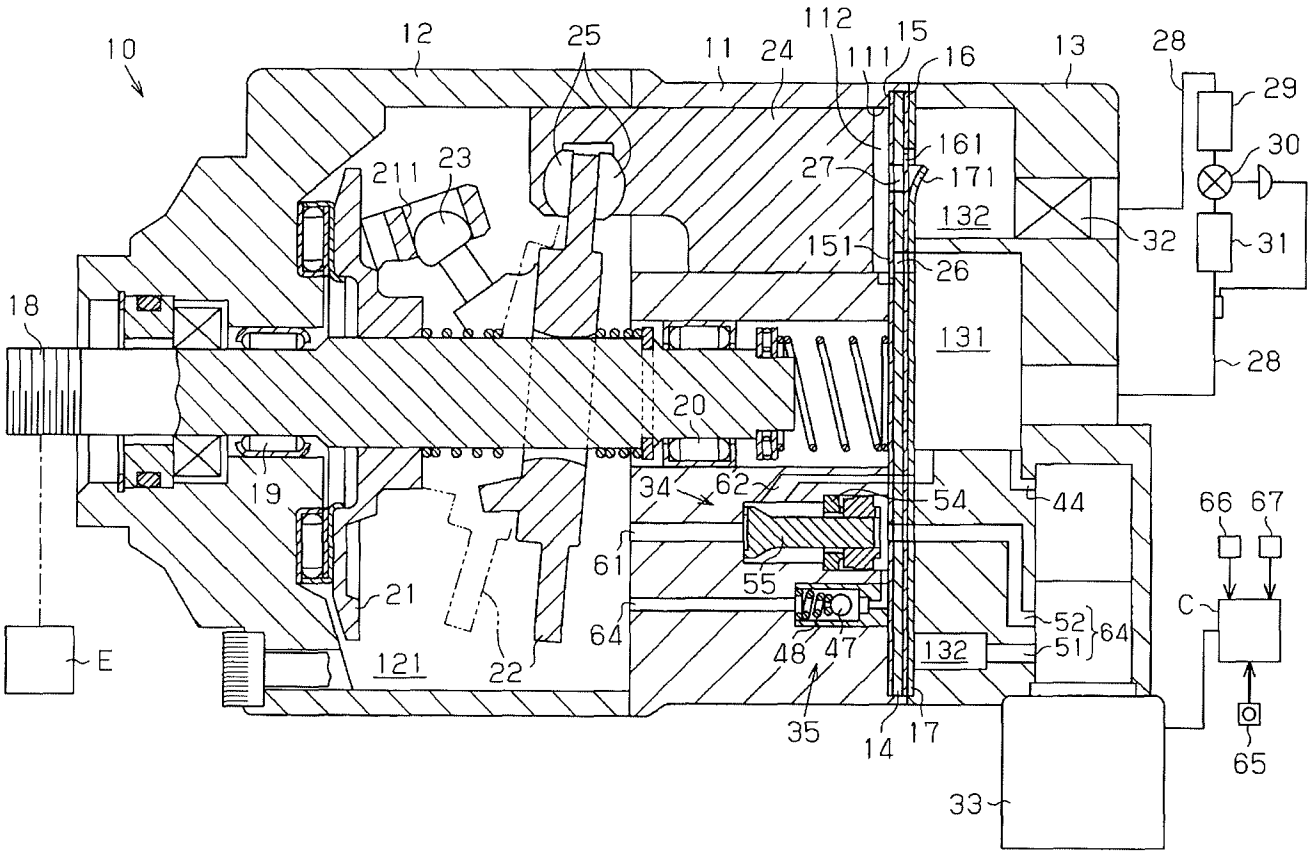
FIG. 1 is a longitudinal sectional view showing a variable displacement compressor according to a first embodiment of the present invention.

The following will describe the variable displacement compressor according to the first embodiment of the present invention with reference to FIGS. 1 through 4. The variable displacement compressor of the present embodiment is of a clutchless type that receives rotary drive force from an external drive source E such as vehicle engine without intervention of a clutch. It is noted that the left-hand side and the right-hand side of the variable displacement compressor 10 as viewed in FIG. 1 correspond to the front and rear of the variable displacement compressor 10, respectively. As shown in FIG. 1, the compressor 10 has a compressor housing including a cylinder block 11, a front housing 12 joined at the front end of the cylinder block 11, and a rear housing 13 joined at the rear end of the cylinder block 11 via a valve plate 14, a suction valve forming plate 15, a discharge valve forming plate 16 and a retainer forming plate 17.

The front housing 12 and the cylinder block 11 cooperate to form a crank chamber 121. A rotary shaft 18 is rotatably supported by radial bearings 19 and 20 in the front housing 12 and the cylinder block 11, respectively. The front end of the rotary shaft 18 is exposed outside the front housing 12 and receives rotary drive force from the external drive source E.

A lug plate 21 is fixed on the rotary shaft 18 adjacently to the front end of the front housing 3 within the crank chamber 121. A swash plate 22 is supported by the rotary shaft 18 behind the lug plate 21 in the crank chamber 121. The swash plate 22 is slidable in the axial direction of the rotary shaft 18.

The swash plate 22 has on the side thereof adjacent to the lug plate 21 a pair of guide pins 23 and the lug plate 21 has on the side thereof adjacent to the swash plate 22 a pair of guide holes 211. The paired guide pins 23 of the swash plate 22 are slidably fitted in the paired guide holes 211 of the lug plate 21. Such arrangement of the guide pins 23 and the guide holes 211 allows the swash plate 22 to incline relative to the axial direction of the rotary shaft 18 while rotating integrally with the rotary shaft 18. The inclination angle of the swash plate 22 is an angle that is made between the swash plate 22 and an imaginary plane that is perpendicular to the axis of the rotary shaft 18. The inclination of the swash plate 22 is guided by the slide engagement between the guide pins 23 and the guide holes 211 and between the swash plate 22 and the rotary shaft 18.

The inclination angle of the swash plate 22 increases with movement of the central portion of the swash plate 22 toward the lug plate 21. The maximum inclination of the swash plate 22, which is shown by chain double-dashed line in FIG. 1, is restricted by contact of the swash plate 22 with the lug plate 21. The minimum inclination of the swash plate 22, which is shown by solid line in FIG. 1, is set slightly larger than zero degree.

The cylinder block 11 has therethrough a plurality of cylinder bores 111 in which pistons 24 are received. The rotation of the swash plate 22 is converted into the reciprocating movement of the pistons 24 in the cylinder bores 111 via shoes 25.

The rear housing 13 has therein a suction chamber 131 as a suction-pressure region and also a discharge chamber 132 as a discharge-pressure region. Suction ports 26 are formed through the valve plate 14, the discharge valve forming plate 16 and the retainer forming plate 17. Discharge ports 27 are formed through the valve plate 14 and the suction valve forming plate 15. Suction valves 151 are formed in the suction valve forming plate 15, and discharge valves 161 are formed in the discharge valve forming plate 16. Each cylinder bore 111 has between its corresponding piston 17 and the suction valve forming plate 15 a compression chamber 112.

As the piston 24 moves leftward in its cylinder bore 111 as seen in FIG. 1, refrigerant is drawn from the suction chamber 131 into the compression chamber 112 through the suction port 26 while pushing open the suction valve 151. As the piston 24 moves rightward in the cylinder bore 111 as seen in FIG. 1, the refrigerant then in the compression chamber 112 is compressed and discharged out of the compression chamber 112 into the discharge chamber 132 through the discharge port 27 while pushing open the discharge valve 161. The opening of the discharge valve 161 is restricted by a retainer 171 of the retainer forming plate 17.

As the pressure in the crank chamber 121 decreases, the inclination angle of the swash plate 22 is increased and hence the displacement of the variable displacement compressor is increased. As the pressure in the crank chamber 121 increases, the inclination angle of the swash plate 22 is decreased and hence the displacement of the variable displacement compressor is decreased. The suction chamber 131 and the discharge chamber 132 are connected by an external refrigerant circuit 28 in which a condenser 29 for removing heat from the refrigerant, an expansion valve 30 and an evaporator 31 for allowing the refrigerant to absorb the ambient heat are connected. The expansion valve 30 is operable to automatically regulate the flow rate of refrigerant according to the variation in the temperature of the refrigerant gas at the outlet of the evaporator 31. A circulation regulator 32 is located in a refrigerant passage between the discharge chamber 132 and the external refrigerant circuit 28. When the circulation regulator 32 opens the passage between the discharge chamber 132 and the external refrigerant circuit 28, the refrigerant in the discharge chamber 132 returns to the suction chamber 131 via the external refrigerant circuit 28.

Figure 3:
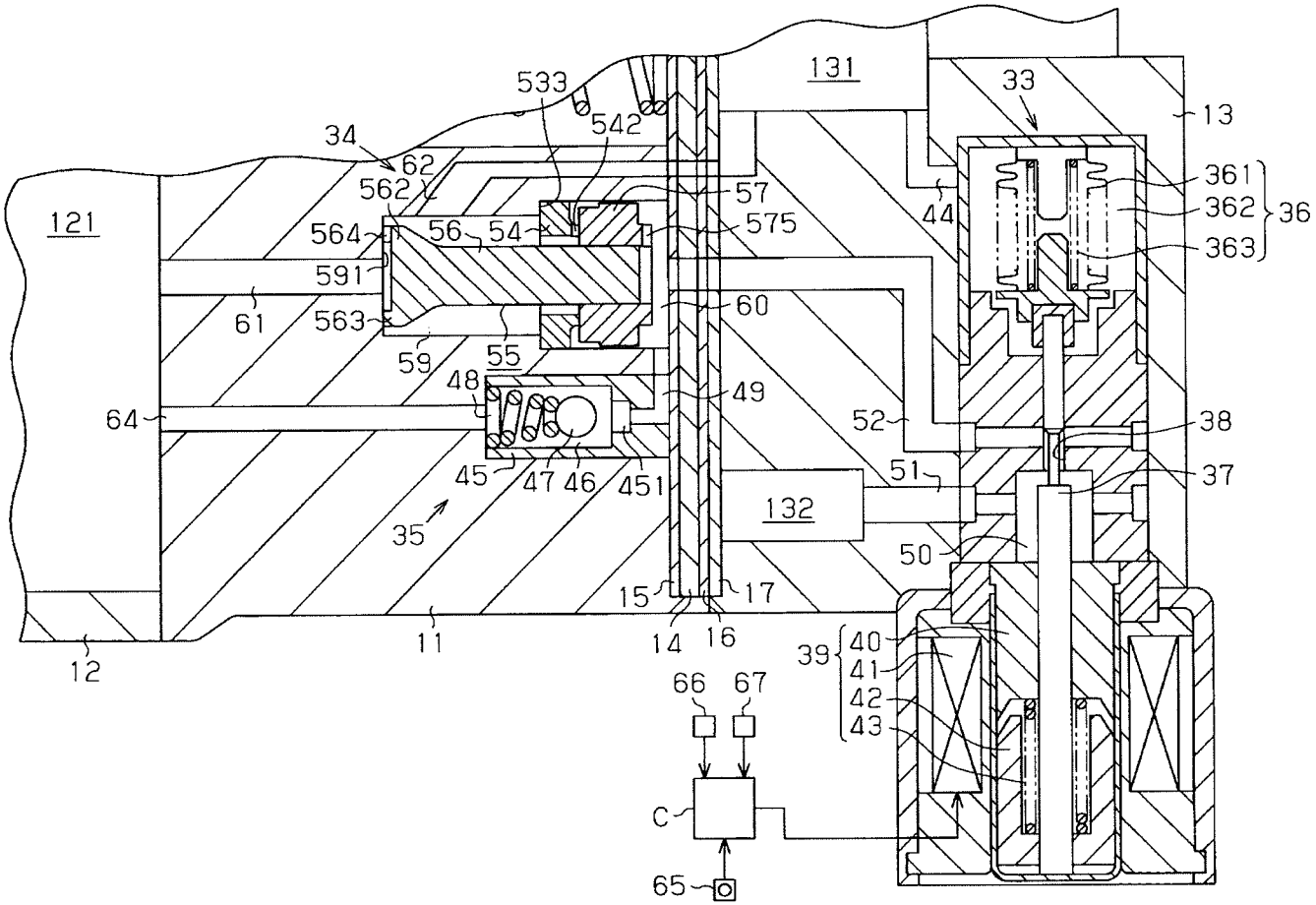
FIG. 3 is a fragmentary enlarged view of the compressor of FIG. 1.

An electromagnetically-operated first control valve 33 is mounted in the rear housing 13. Referring to FIG. 3, the first control valve 33 has a solenoid 39 that includes a stationary core 40, a coil 41, a moving core 42 and a spring 43. Supplying an electric current to the coil 41, the stationary core 40 is magnetized to attract the moving core 42 toward the stationary core 40. A valve rod 37 is fixed to the moving core 42. The spring 43 is disposed between the stationary core 40 and the moving core 42. The electromagnetic force of the solenoid 39 urges the valve rod 37 in the direction that closes a valve hole 38 of the first control valve 33 against the urging force of the spring 43. Operation of the solenoid 39 is controlled by a controller C (shown in FIG. 1) with electric current. In this present embodiment, the operation of the solenoid 39 is controlled by the controller C with duty ratio.

The first control valve 33 has a pressure sensor 36 that includes a bellows 361, a pressure-sensitive chamber 362 and a pressure-sensitive spring 363. The pressure in the suction chamber 131 (or suction pressure) is applied to the bellows 361 via a passage 44 and the pressure-sensitive chamber 362. The bellows 361 is connected to the valve rod 37. The pressure in the bellows 361 and the urging force of the pressure-sensitive spring 363 of the pressure sensor 36 urge the valve rod 37 in the direction that opens the valve hole 38. A valve chamber 50 is formed between the stationary core 40 and the valve hole 38 and communicates with the discharge chamber 132 via a passage 51.

Figure 2:
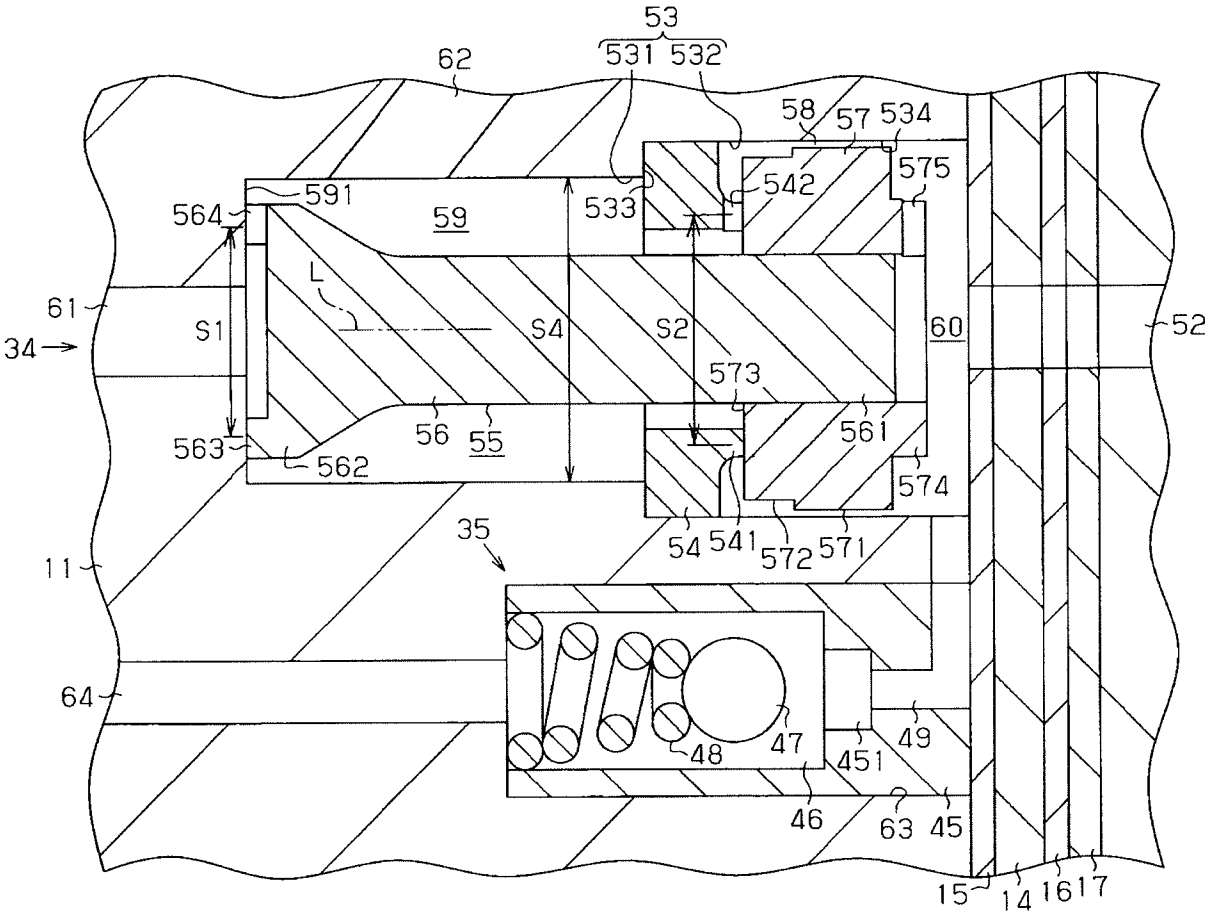
FIG. 2 is a fragmentary enlarged view of the compressor of FIG. 1.

Referring to FIG. 2, the cylinder block 11 has in the end face thereof adjacent to the suction valve forming plate 15 a valve chamber 53. The valve chamber 53 is divided into a first chamber 531 and a second chamber 532 that is larger in diameter than the first chamber 531. A ring 54 that serves as the valve seat member of the present invention is disposed in the second chamber 532. The outside diameter of the ring 54 is slightly smaller than the diameter of the second chamber 532 and the front surface of the ring 54 is contactable with a stepped surface 533 formed between the first chamber 531 and the second chamber 532.

A valve member 55 is disposed in the valve chamber 53 so as to extend through the inside of the ring 54. The valve member 55 has a first valve portion 56 that extends axially in the first chamber 531 and the second chamber 532 through the inside of the ring 54, and a second valve portion 57 that is fixedly mounted to the first valve portion 56 in the second chamber 532.

The first valve portion 56 has a small-diameter portion 561 inserted in the second valve portion 57, and a large-diameter portion 562 disposed in the first chamber 531. The inside diameter of the ring 54 is larger than the outside diameter of the small-diameter portion 561 but smaller than the outside diameter of the large-diameter portion 562.

The outer circumferential surface of the second valve portion 57 has a first circumferential surface 571 and a second circumferential surface 572 whose radius of curvature is smaller than that of the first circumferential surface 571. The diameter of a circle defining the first circumferential surface 571 of the second valve portion 57 is smaller than the diameter of the second chamber 532 so that an annular clearance 58 is formed between the outer circumferential surface of the second valve portion 57 and the inner circumferential surface 534 of the second chamber 532. The second valve portion 57 divides the valve chamber 53 into a bleed chamber 59, a backpressure chamber 60 and the annular clearance 58 that provides fluid communication between the bleed chamber 59 and the backpressure chamber 60. The annular clearance 58 serves as the communication passage of the present invention.

When the valve member 55 is inclined in the valve chamber 53 to come into contact with the inner circumferential surface of the valve chamber 53, the outer edge of the distal end of the annular projection 563 of the first valve portion 56 and the edge of the first circumferential surface 571 of the second valve portion 57 on the side adjacent to the backpressure chamber 60 come into contact with the inner circumferential surface of the valve chamber 53. That is, the edge of the second circumferential surface 572 of the second valve portion 57 on the side adjacent to the bleed chamber 59 never comes into contact with the inner circumferential surface of the valve chamber 53.

The bleed chamber 59 is in communication with the crank chamber 121 via a valve hole 61 that is opened to the bottom surface 591 of the bleed chamber 59 (or the bottom of the valve chamber 53), as shown in FIG. 3. The bleed chamber 59 is also in communication with the suction chamber 131 via a passage 62 that is opened to the circumferential surface of the bleed chamber 59. The valve hole 61, the bleed chamber 59 and the passage 62 cooperate to form a bleed passage for allowing refrigerant in the crank chamber 121 to be discharged into the suction chamber 131.

The backpressure chamber 60 is in communication with the valve hole 38 of the first control valve 33 via a passage 52 formed through the valve plate 14, the suction valve forming plate 15, the discharge valve forming plate 16, the retainer forming plate 17 and the rear housing 13.

The ring 54 has on the side thereof adjacent to the second valve portion 57 an annular projection 541, as shown in FIG. 2. The annular projection 541 is formed with a first cutout groove 542. The end surface 573 of the second valve portion 57 adjacent to the bleed chamber 59 is contactable with the distal end surface of the annular projection 541. When the end surface 573 of the second valve portion 57 is in contact with the distal end surface of the annular projection 541, the first cutout groove 542 serves as the restricted passage of the present invention.

The annular projection 563 of the first valve portion 56 is formed at the distal end thereof with a second cutout groove 564. The distal end surface of the annular projection 563 is contactable with the bottom surface 591 of the bleed chamber 59. When the distal end surface of the annular projection 563 is in contact with the bottom surface 591 of the bleed chamber 59, the second cutout groove 564 serves also as the restricted passage of the present invention.

The effective area S1 of the first valve portion 56 that is subjected to the pressure in the valve hole 61 when the valve hole 61 is closed by the valve member 55 is the cross-sectional area that spans radially inward of the annular projection 563 in an imaginary plane perpendicular to the axis L of the ring 54. The effective area S2 of the second valve portion 57 that is subjected to the pressure in the bleed chamber 59 when the valve hole 61 is closed by the valve member 55 is the cross-sectional area that spans radially inward of the ring 54 in an imaginary plane perpendicular to the axis L of the ring 54. The effective area S2 of the second valve portion 57 is set 1 to 1.2 times the effective area S1 of the first valve portion 56. That is, S2/S1 which will be represented by $\alpha$ is set in the range of 1 to 1.2.

The effective area of the second valve portion 57 that is subjected to the pressure in the passage 52 (hence the pressure in the backpressure chamber 60) is substantially the same as the effective area S2 of the second valve portion 57 that is subjected to the pressure in the bleed chamber 59. The effective area S2 is smaller than the cross-sectional area S4 of the first chamber 531 of the valve chamber 53 (that spans in an imaginary plane perpendicular to the axis L of the ring 54).

The second valve portion 57 has on the side thereof adjacent to the suction valve forming plate 15 an annular projection 574. The annular projection 574 of the second valve portion 57 is formed with a third cutout groove 575. The distal end surface of the annular projection 574 is contactable with the suction valve forming plate 15. When the distal end surface of the annular projection 574 is in contact with the suction valve forming plate 15, the annular clearance 58 and the passage 52 are in communication with each other via the third cutout groove 575.

The valve chamber 53, the valve hole 61, the valve member 55 and the ring 54 cooperate to form the second control valve 34 for adjusting the cross-sectional area of the bleed passage. The cylinder block 11 receives therein the second control valve 34, serving as the casing of the present invention. To fix the first valve portion 56 and the second valve portion 57 together, the small-diameter portion 561 of the first valve portion 56 is inserted through the ring 54 and then the first valve portion 56 is fitted into the second valve portion 57. By so doing, the ring 54 is fixed securely to the valve member 55. The valve member 55 and the ring 54 thus fixed together are inserted into the valve chamber 53.

The cylinder block 11 has on the side thereof adjacent to the suction valve forming plate 15 an insertion hole 63 in which a check valve 35 is received. The check valve 35 has a valve housing 45 received in the insertion hole 63, a valve chamber 46 formed in the valve housing 45, a ball valve 47 received in the valve chamber 46 and a shut-off spring 48 located between the ball valve 47 and the bottom surface of the insertion hole 63. The valve housing 45 has therein a valve hole 451 and the shut-off spring 48 urges the ball valve 47 in the direction that closes the valve hole 451. The valve hole 451 is in communication with the backpressure chamber 60 of the second control valve 34 via a passage 49 formed in the valve housing 45 and the cylinder block 11.

The valve chamber 46 is in communication with the crank chamber 121 via a passage 64 formed in the cylinder block 11, as shown in FIG. 3. The passages 51, 52, the backpressure chamber 60, the passage 49, the valve chamber 46 and the passage 64 cooperate to form a supply passage for allowing refrigerant in the discharge chamber 132 to be supplied into the crank chamber 121.

The controller C, which controls the operation of the solenoid 39 of the first control valve 33 with electric current (duty ratio), supplies electric current to the solenoid 39 by turning on the air conditioner switch 65 and stops the supply of the electric current by turning off the air conditioner switch 65. A room temperature setting device 66 and a room temperature detector 67 are electrically connected to the controller C. With the air conditioner switch 65 turned on, the controller C controls the electric current supplied to the solenoid 39 based on the difference between the target temperature set by the room temperature setting device 66 and the temperature detected by the room temperature detector 67.

The opening of the valve hole 38 of the first control valve 33, or the opening of the first control valve 33, depends on the relation among various forces such as the electromagnetic force generated by the solenoid 39, the urging force of the spring 43 and the urging force of the pressure sensor 36. The first control valve 33 varies the electromagnetic force of the solenoid 39 thereby to continuously adjust the opening of the first control valve 33. With an increase of the electromagnetic force, the opening of the first control valve 33 is decreased. On the other hand, the opening of the first control valve 33 is decreased with an increase of the pressure in the suction chamber 131 (or suction pressure). The opening of the first control valve 33 is increased with a decrease of the pressure in the suction chamber 131 (or suction pressure). The first control valve 33 controls so that the suction pressure becomes a target pressure in accordance with the electromagnetic force.

FIG. 3 shows a state where the supply of electric current to the solenoid 39 of the first control valve 33 is stopped (duty ratio is zero) by turning off the air conditioner switch 65. Then, the opening of the first control valve 33 is at its maximum. Since the minimum inclination angle of the swash plate 22 is slightly larger than zero degree, the discharge of refrigerant from the cylinder bore 111 to the discharge chamber 132 is performed when the inclination angle of the swash plate 22 is at the minimum. When the swash plate 22 is at the minimum inclination angle, the circulation regulator 32 is closed to prevent the circulation of refrigerant in the external refrigerant circuit 28.

The refrigerant discharged from the cylinder bore 111 into the discharge chamber 132 flows into the backpressure chamber 60 of the second control valve 34 via the valve hole 38 of the first control valve 33. The valve member 55 of the second control valve 34 is moved to its closed position where the projection 563 of the first valve portion 56 is in contact with the bottom surface of the valve chamber 53 by the pressure in the backpressure chamber 60. The end surface 573 of the second valve portion 57 adjacent to the bleed chamber 59 comes into contact with the distal end surface of the projection 541. The ring 54 is pressed against the stepped surface 533 by the pressure in the backpressure chamber 60. The refrigerant in the backpressure chamber 60 flows back to the suction chamber 131 via the annular clearance 58, the first cutout groove 542, the bleed chamber 59 and the passage 62 or the passage 49, the valve chamber 46, the passage 64, the crank chamber 121, the valve hole 61, the second cutout groove 564, the bleed chamber 59 and the passage 62.

During the operation of the compressor 10 at its minimum displacement, the pressure acting on the second control valve 34 is expressed by the inequality (1).

$$Pcv>(Pc-Ps)/\alpha+Ps \quad (1)$$

where Pcv, Pc and Ps represent the pressure in the backpressure chamber 60, the pressure in the crank chamber 121, and the pressure in the suction chamber 131, respectively.

Refrigerant in the backpressure chamber 60 flows into the valve chamber 46 via the passage 49 and the valve hole 451 of the check valve 35 while pushing past the ball valve 47. The refrigerant in the valve chamber 46 flows into the crank chamber 121 via the passage 64. Thus, the refrigerant in the discharge chamber 132 flows into the crank chamber 121 via the supply passage. The refrigerant in the crank chamber 121 flows into the suction chamber 131 via the valve hole 61, the second cutout groove 564, the bleed chamber 59 and the passage 62. The refrigerant in the suction chamber 131 is drawn into the respective cylinder bore 111 for compression and discharged into the discharge chamber 132.

In the state of the compressor 10 of FIG. 3, the swash plate 22 is placed in its minimum inclination angle position. Thus, the variable displacement compressor 10 is operated at its minimum displacement. In this case, the circulation regulator 32 is closed, so that no refrigerant circulates in the external refrigerant circuit 28.

Figure 4:
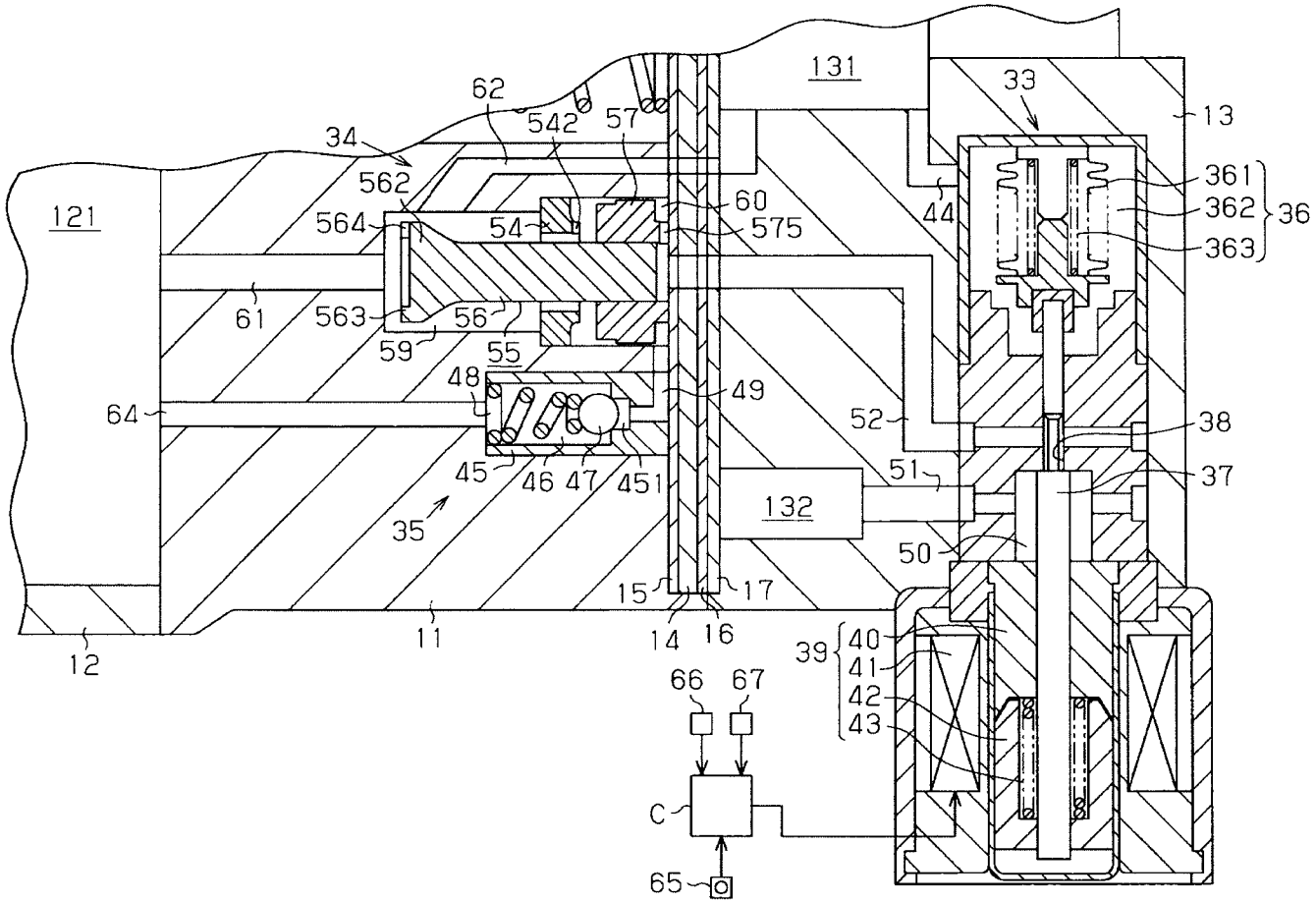
FIG. 4 is a fragmentary enlarged view of the compressor of FIG. 1.

FIG. 4 shows a state where the air conditioner switch 65 is turned on and the supply of electric current to the solenoid 39 of the first control valve 33 is maximized (i.e. the duty ratio is one). Accordingly, the opening of the first control valve 33 is zero. When the variable displacement compressor 10 is being operated at any displacement other than its minimum displacement (or the swash plate 22 is at an inclination angle other than the minimum inclination angle), the circulation regulator 32 is opened to allow circulation of refrigerant in the external refrigerant circuit 28.

When the opening of the first control valve 33 is zero (or when the valve hole 38 is closed), no refrigerant in the discharge chamber 132 flows into the backpressure chamber 60 of the second control valve 34 via the supply passage. Thus, the valve member 55 of the second control valve 34 is moved to a position where the valve member 55 comes in contact with the suction valve forming plate 15 by the pressure in the bleed chamber 59 which communicates with the suction chamber 131 and also the pressure in the valve hole 61 (or the pressure in the crank chamber 121). The ball valve 47 of the check valve 35 is moved to a position where the ball valve 47 closes the valve hole 451 by the urging force of the shut-off spring 48.

In the state of the compressor 10 of FIG. 4 where the supply passage is closed, no refrigerant in the discharge chamber 132 flows into the crank chamber 121 via the supply passage, but the refrigerant in the crank chamber 121 flows into the suction chamber 132 via the bleed passage. In this case, the swash plate 22 is placed at its maximum inclination angle position. Thus, the variable displacement compressor 10 is operated at its maximum displacement.

During the operation of the compressor 10 at its maximum displacement, the pressure acting on the second control valve 34 is expressed by the inequality (2).

$$Pcv<(Pc-Ps)/\alpha+Ps \quad (2)$$

In the case where the air conditioner switch 65 is on and the supply of electric current to the solenoid 39 of the first control valve 33 is neither zero nor maximized (i.e. the duty ratio is more than zero and less than one), the refrigerant in the discharge chamber 132 flows into the backpressure chamber 60 of the second control valve 34. Thus, the refrigerant in the crank chamber 121 flows into the suction chamber 131 via the valve hole 61, the second cutout groove 564, the bleed chamber 59 and the passage 62. The refrigerant flowed from the discharge chamber 132 into the backpressure chamber 60 then flows into the crank chamber 121 via the check valve 35. In such a state, the swash plate 22 is placed at an inclination angle that is greater than the minimum inclination angle so that the suction pressure becomes a target pressure in accordance with the duty ratio. Therefore, the variable displacement compressor 10 is operated at an intermediate displacement that is greater than the minimum displacement.

When the first control valve 33 is moved from the open position of FIG. 3 to the closed position, the pressure in the discharge chamber 132 is applied no more to the backpressure chamber 60 and, therefore, the valve member 55 of the second control valve 34 is moved from the closed position of FIG. 3 to the open position of FIG. 4. That is, with the movement of the first control valve 33 from the open position to the closed position, the second control valve 34 is moved from the closed position to the open position. When the second control valve 34 is located in the closed position, the first cutout groove 542 that provides fluid communication between the bleed chamber 59 and the backpressure chamber 60 and also that serves as the restricted passage remains between the end surface 573 of the second valve portion 57 and the ring 54. Thus, the pressure in the backpressure chamber 60 is released into the bleed chamber 59 via the first cutout groove 542. Therefore, the valve member 55 of the second control valve 34 is rapidly moved from the closed position to the open position.

When the first control valve 33 is moved from the closed position of FIG. 4 to the open position, the pressure in the discharge chamber 132 is propagated into the backpressure chamber 60 and, therefore, the valve member 55 of the second control valve 34 is moved from the open position of FIG. 4 to the closed position of FIG. 3.

The following will describe the advantageous effects of the first embodiment of the present invention.

(1) Since no restricted passage is provided between the outer circumferential surface of the second valve portion 57 and the inner circumferential surface 534 of the valve chamber 53 as the restricted passage between the backpressure chamber 60 and the bleed chamber 59, the annular clearance 58 between the outer circumferential surface of the second valve portion 57 and the inner circumferential surface 534 of the valve chamber 53 can be formed large. That is, ingress of any foreign matter into the annular clearance 58 between the outer circumferential surface (first circumferential surface 571) of the second valve portion 57 and the inner circumferential surface 534 of the valve chamber 53 does not impede the operation of the second control valve 34. Therefore, when the variable displacement compressor 10 is started, liquid refrigerant in the crank chamber 121 is rapidly discharged into the suction chamber 131, so that the responsiveness of the second control valve 34 for use in the variable displacement compressor 10 does not deteriorate.

(2) The time necessary for the valve member 55 to move from the closed position to the open position is shortened with a decrease of the ratio $\alpha$ between the effective areas S2 and S1. Thus, the responsiveness of the second control valve 34 is enhanced. However, if the ratio $\alpha$ is less than one, it is difficult to move the valve member 55 from the open position to the closed position. If the ratio $\alpha$ is much more than one, it takes a longer time for the valve member 55 to move from the closed position to the open position after the first control valve 33 has moved from the open position to the closed position. Thus, the responsiveness of the second control valve 34 is worsened. In the variable displacement compressor 10 of the present embodiment wherein $\alpha$ is set in the range from 1 to 1.2, the valve member 55 is moved smoothly to the closed position, so that the responsiveness of the second control valve 34 is enhanced.

(3) Setting the diameter of the second valve portion 57 larger than that of the first valve portion 56, the effective area S2 of the end surface 573 of the second valve portion 57 is larger than the effective area S1 of the distal end surface of the first valve portion 56. The relation between the second valve portion 57 and the first valve portion 56 wherein the former is larger than the latter in diameter is effective in setting the ratio α between the effective areas S2 and S1 to one or more.

(4) The inside diameter of the stepped surface 533 is larger than the maximum diameter of the first valve portion 56 (or the diameter of the large-diameter portion 562). If the stepped surface 533 is used as the valve seat of the second valve portion 57, the inside diameter of the valve seat is larger than the maximum diameter of the first valve portion 56 (or the diameter of the large-diameter portion 562). That is, the effective area S2 of the second valve portion 57 subjected to the pressure in the bleed chamber 59 is inevitably larger than the cross-sectional area of the large-diameter portion 562 of the first valve portion 56, which makes it difficult to set the ratio α between the effective areas S2 and S1 in the range from 1 to 1.2.

The inside diameter of the ring 54 that serves as the valve seat member of the second valve portion 57 may be set smaller than the maximum diameter of the first valve portion 56 (or the diameter of the large-diameter portion 562). Therefore, the variable displacement compressor 10 according to the present embodiment wherein the ring 54 that serves as the valve seat of the second valve portion 57 is formed separately from the cylinder block 11 (casing) enables the ratio α between the effective areas S2 and S1 to be set in the range from 1 to 1.2.

(5) During the operation of the variable displacement compressor 10 at a relatively high displacement in the intermediate displacement, there is fear that the pressure in the crank chamber 121 fails to be reduced when the first control valve 33 is moved from the open position due to refrigerant leakage from the cylinder bore 111 to the crank chamber 121. If the pressure in the crank chamber 121 which failed to be reduced is propagated to the backpressure chamber 60 via the supply passage, the pressure in the bleed chamber 59 (corresponding to suction pressure) and the pressure in the valve hole 61 (corresponding to crank chamber pressure) may not exceed the pressure in the backpressure chamber 60. In such a case, the valve member 55 of the second control valve 34 cannot move from the closed position toward the open position.

The check valve 35 prevents the crank chamber pressure which failed to be reduced from being propagated to the backpressure chamber 60. Therefore, when the first control valve 33 moves from the open position to the closed position, the valve member 55 of the second control valve 34 is moved smoothly from the closed position to the open position.

(6) The first cutout groove 542 formed in the ring 54 for fluid communication between the backpressure chamber 60 and the bleed chamber 59 provides advantageously simple restricted passage.

(7) The second cutout groove 564 formed in the first valve portion 56 for fluid communication between the valve hole 61 and the bleed chamber 59 provides advantageously simple restricted passage.

(8) The ring 54 is pressed against the stepped surface 533 by the pressure in the backpressure chamber 60. Thus, there is no need to fit the ring 54 into the second chamber 532 of the valve chamber 53 and then to press it against the stepped surface 533. Therefore, inserting the ring 54 and the valve member 55 into the valve chamber 53 is easily performed.

(9) The second valve portion 57 has a first circumferential surface 571 at the end of the first valve portion 56 opposite from the large-diameter portion 562. Therefore, the distance between two points of the valve member 55 at which the valve member 55 is brought into contact with the inner circumferential surface of the valve chamber 53 when the valve member 55 is inclined in the valve chamber 53 may be set so long that the inclination of the valve member 55 is restricted. As a result, the valve member 55 that serves as the float valve of the present invention can be moved smoothly.

The present invention has been described in the context of the above first embodiment, but it is not limited to the embodiment. It is obvious to those skilled in the art that the invention may be practiced in various manners as exemplified below.

Figure 5:
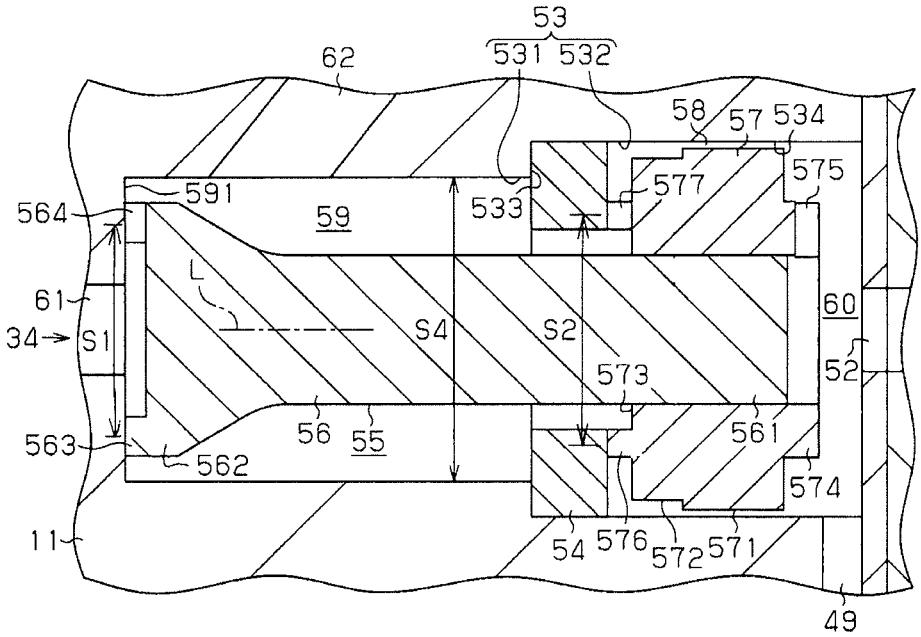
FIG. 5 is a fragmentary enlarged longitudinal sectional view showing a variable displacement compressor according to a modification of the first embodiment of the present invention.

The second valve portion 57 may have on the end surface 573 thereof an annular projection 576 as shown in FIG. 5. The annular projection 576 is formed with a first cutout groove 577. The projection 576 and the first cutout groove 577 serve as an equivalent to the projection 541 and the first cutout groove 542, respectively.

Figure 6:
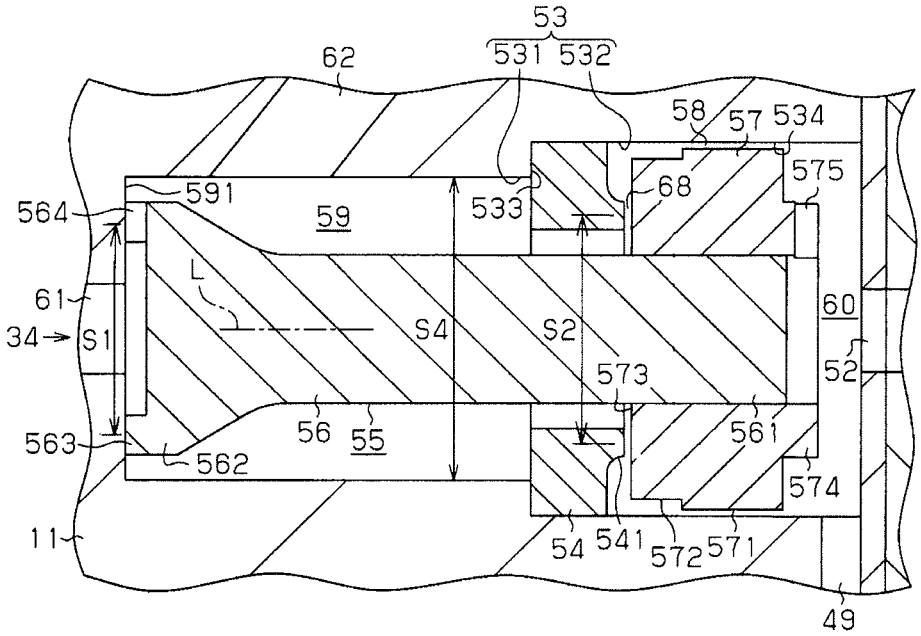
FIG. 6 is a fragmentary enlarged longitudinal sectional view showing a variable displacement compressor according to another modification of the first embodiment of the present invention.

The ring 54 may dispense with the first cutout groove 542 of the first embodiment and it may be so arranged that, when the distal end surface of the annular projection 563 is in contact with the bottom surface 591 of the bleed chamber 59, the end surface 573 of the second valve portion 57 and the distal end surface of the projection 541 have therebetween a clearance 68 that serves as the restricted passage of the present invention, as shown in FIG. 6.

Figure 7:
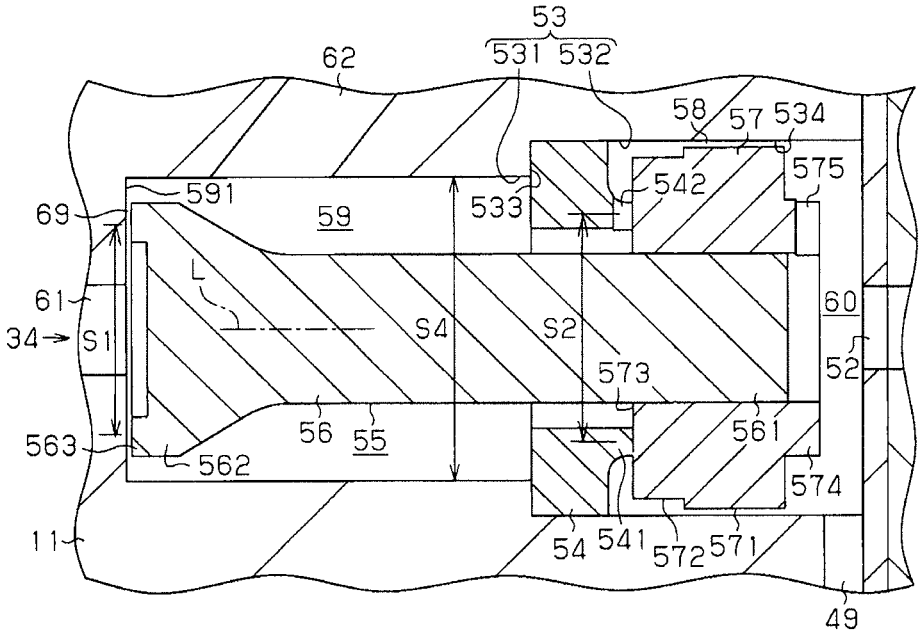
FIG. 7 is a fragmentary enlarged longitudinal sectional view showing a variable displacement compressor according to yet another modification of the first embodiment of the present invention.

The first valve portion 56 may dispense with the second cutout groove 564 of the first embodiment and it may be so arranged that, when the end surface 573 of the second valve portion 57 is in contact with the distal end surface of the projection 541, the distal end surface of the projection 563 and the bottom surface 591 may have therebetween a clearance 69 that serves as the restricted passage of the present invention, as shown in FIG. 7.

Figure 8:
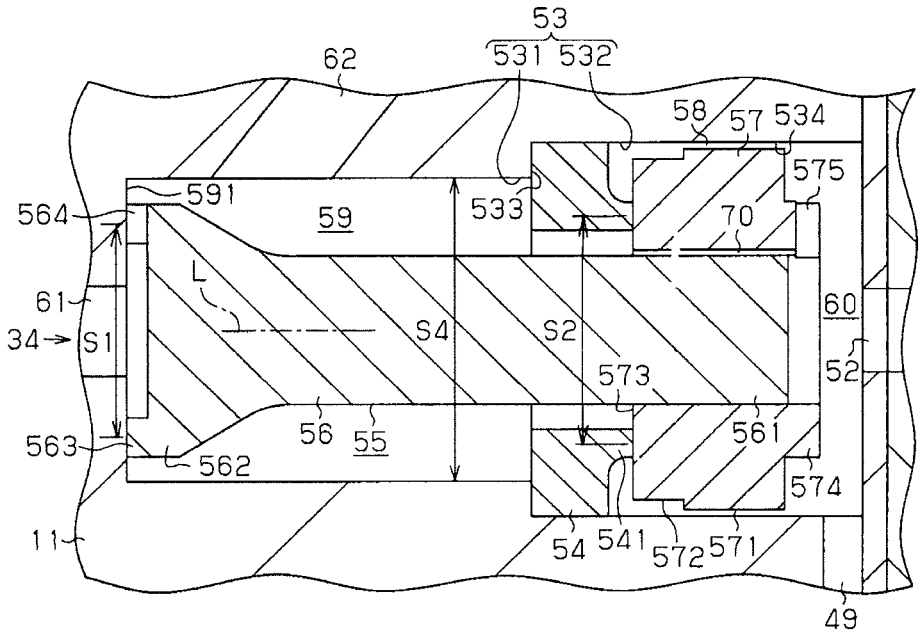
FIG. 8 is a fragmentary enlarged longitudinal sectional view showing a variable displacement compressor according to yet another modification of the first embodiment of the present invention.

The ring 54 may dispense with the first cutout groove 542 of the first embodiment and the second valve portion 57 may have a restricted passage 70 that provides fluid communication between the bleed chamber 59 and the backpressure chamber 60, as shown in FIG. 8.

The valve chamber 53 may be provided in the rear housing 13.

The check valve 35 may be provided in the rear housing 13.

The ring 54 may be fitted in the second chamber 532 of the valve chamber 53.

The passage 49 for the check valve 35 may be directly connected to the passage 52 located between the first control valve 33 and the second control valve 34. This modification also offers the same effects of the first embodiment.

Any spring may be provided between the ring 54 and the second valve portion 57.

The variable displacement compressor 10 may dispense with the check valve 35. Alternatively, any restricted passage may be provided instead of the check valve 35. These modifications also offer the same effect (1) of the first embodiment.

A control valve having a pressure sensor and operable to vary the valve opening in accordance with the pressure difference between two points in the discharge-pressure region may be used as the first control valve. That is, the control valve whose valve opening is increased with an increase of the flow rate of the refrigerant gas in the discharge-pressure region and whose valve opening is decreased with a decrease of the flow rate of the refrigerant gas in the discharge-pressure region, may be used as the first control valve.

The present invention may be applied to a variable displacement compressor which receives rotary drive force from the external drive source through a clutch. In such a variable displacement compressor, when the clutch is engaged to connect the external drive source and the compressor, refrigerant circulates through the external refrigerant circuit even when the swash plate of the compressor is at the minimum inclination angle. When the clutch is disengaged to disconnect the external drive source and the compressor, refrigerant is prevented from circulating through the external refrigerant circuit.

What is claimed is:

1. A variable displacement compressor in which a suction-pressure region, a discharge-pressure region and a crank chamber are formed, wherein displacement of the variable displacement compressor varies in accordance with pressure in the crank chamber, the variable displacement compressor comprising:

a supply passage for allowing refrigerant in the discharge-pressure region to be supplied into the crank chamber;

a bleed passage for allowing the refrigerant in the crank chamber to be discharged to the suction-pressure region;

a first control valve for adjusting a cross-sectional area of the supply passage; and a second control valve for adjusting a cross-sectional area of the bleed passage, the second control valve comprising:

a valve hole for forming a part of the bleed passage, the valve hole being opened to the crank chamber;

a valve chamber opened to the valve hole;

a first valve portion disposed in the valve chamber for adjusting a cross-sectional area of the valve hole;

a second valve portion disposed in the valve chamber for dividing the valve chamber into a bleed chamber, a backpressure chamber and a communication passage, the bleed chamber forming a part of the bleed passage, the backpressure chamber communicating with the supply passage, the communication passage being formed between an outer circumferential surface of the second valve portion and an inner circumferential surface of the valve chamber for providing fluid communication between the bleed chamber and the backpressure chamber; and a valve seat member disposed in the bleed chamber, the valve seat member being provided separately from a compressor housing forming the valve chamber, wherein when the second control valve is placed in a closed position, a restricted passage remains between one end surface of the second valve portion that is adjacent to the bleed chamber and the valve seat member for providing fluid communication between the bleed chamber and the backpressure chamber.

2. The variable displacement compressor according to claim 1, wherein the valve seat member is contactable with the one end surface of the second valve portion that is adjacent to the bleed chamber.

3. The variable displacement compressor according to claim 1, wherein the first valve portion and the second valve portion are provided separately and connected to each other.

4. The variable displacement compressor according to claim 1, wherein the restricted passage is a cutout groove formed in the valve seat member.

5. The variable displacement compressor according to claim 1, wherein the first valve portion has a cutout groove that provides fluid communication between the valve hole and the bleed chamber.

6. The variable displacement compressor according to claim 1, wherein the valve chamber has a first chamber and a second chamber that is larger in diameter than the first chamber, the first valve portion being disposed in the first chamber and the second chamber, the second valve portion being disposed in the second chamber, the communication passage being an annular clearance.

7. The variable displacement compressor according to claim 1, wherein a check valve is provided between the first control valve and the crank chamber for allowing the refrigerant in the supply passage to flow only from the first control valve toward the crank chamber.

8. The variable displacement compressor according to claim 1, wherein an effective area of the second valve portion which is subjected to pressure in the bleed chamber is set 1 to 1.2 times an effective area of the first valve portion which is subjected to pressure in the valve hole.

9. The variable displacement compressor according to claim 1, wherein the first valve portion and the second valve portion cooperate to form a float valve.

* * * * *